United States Patent [19]

Leu

[11] Patent Number: 4,572,483

[45] Date of Patent: Feb. 25, 1986

[54] CUTTING TORCH

[75] Inventor: Don J. Leu, Changhua Hsien, Taiwan

[73] Assignee: I Ling Industry Co., Ltd., Taipei, Taiwan

[21] Appl. No.: 616,188

[22] Filed: May 30, 1984

[51] Int. Cl.[4] ..... B23K 7/00

[52] U.S. Cl. ..... 266/48; 239/419.3; 239/424.5; 239/397.5

[58] Field of Search ..... 266/48; 239/419.3, 424.5, 239/397.5

[56] References Cited

U.S. PATENT DOCUMENTS

| | | | |
|---|---|---|---|
| 1,340,690 | 5/1920 | Coberly | 266/48 |
| 1,461,873 | 7/1923 | Grote | 239/419.3 |
| 2,198,342 | 4/1940 | Jacobsson et al. | 239/424.5 |
| 2,335,500 | 11/1943 | Errett | 239/419.3 |
| 2,519,939 | 8/1950 | Smith | 239/424.5 |
| 3,078,913 | 2/1963 | Anthes | 239/397.5 |
| 4,022,441 | 5/1977 | Turney | 239/424.5 |
| 4,248,384 | 2/1981 | Zwicker | 239/419.3 |
| 4,413,809 | 11/1983 | Fischer | 266/48 |
| 4,458,884 | 7/1984 | Fischer | 266/48 |

*Primary Examiner*—Wayland Stallard

[57] ABSTRACT

Disclosed is a cutting torch having a preheat tube in which the mixing structure within the preheat tube includes both a heat absorbing spiral and a blunt-nosed jet in the oxygen passageway upstream of the injection point at which the fuel is mixed with oxygen. The jet is simple to machine during the manufacturing of the torch parts and, when properly positioned, causes sufficient turbulence in oxygen flow to assure complete and consistent mixing of the oxygen with the fuel, even at low fuel pressures. The actual mixing of the fuel with the oxygen is accomplished at a point immediately downstream of the jet where a plurality of transverse passageways leading from a fuel carrying channel intersect the central passageway leading from the jet. These transverse passageways are preferably disposed at an acute angle to the longitudinal axis of the mixer tube such that the transverse passageways are pointed downstream and inwardly toward the center of the mixer tube.

19 Claims, 6 Drawing Figures

CUTTING TORCH

This invention relates to the field of oxygen-fuel cutting torches and in particular to a new design of preheat tube for mixing the oxygen and fuel for the preheat flame of the torch.

BACKGROUND OF THE INVENTION

A majority of the components of a hand held cutting torch have become relatively standardized in their function, structure and appearance. However, continuing development of the structure for mixing the oxygen and the fuel for the preheat flame of the torch has occurred in an effort to overcome long existent problems with hand held cutting torches. These problems include the susceptibility of the torch to potentially dangerous flashbacks or popping caused by the burning of the fuel-oxygen mixture within the torch itself. These flashbacks create high pressure shock waves within the torch which can rupture the wall of the torch or cause a chain reaction of flashbacks sending burning fuel and oxygen in one or both of the fuel and oxygen supply lines.

The flashback problem is worsened when using so-called low pressure fuels such as MAPP gas in a torch which is designed for higher pressure gases such as acetylene.

Other problems with prior art torches include incomplete or inconsistent mixing of the oxygen and fuel resulting in rough and unstable preheat flames.

It is an object of the present invention to provide a torch which obviates the tendency to flashback and which minimizes the potential danger of such flashbacks if they do occur.

It is a further object of the present invention to provide a cutting torch which minimizes the susceptibility of the torch to flashback danger while at the same time assuring adequate mixing of the fuel and oxygen, without unnecessarily increasing the cost of producing the torch.

It is still another object of the present invention to provide a cutting torch having a preheat tube which includes an improved mixing structure which is simple to manufacture and which assures proper mixing of the fuel and oxygen and proper control of the fuel flow to minimize the occurrence of flashbacks and which immediately extinguishes the flashbacks that do occur in order to prevent any dangerous sustained burning or chain reaction flashbacks.

SUMMARY OF THE INVENTION

The above-mentioned objects of the invention are achieved by providing a cutting torch having a preheat tube in which the mixing structure within the preheat tube includes both a heat absorbing spiral and a blunt-nosed, jet in the oxygen passageway upstream of the injection point at which the fuel is mixed with oxygen. The jet is simple to machine during the manufacturing of the torch parts and, when properly positioned, causes sufficient turbulence in oxygen flow to assure complete and consistent mixing of the oxygen with the fuel, even at low fuel pressures.

The actual mixing of the fuel with the oxygen is accomplished at a point immediately downstream of the jet where a plurality of transverse passageways leading from the fuel carrying channel intersect the central passageway leading from the jet. These transverse passageways are preferably disposed at an acute angle to the longitudinal axis of the mixer tube such that the transverse passageways are pointed downstream and inwardly toward the center of the mixer tube. This assures that the fuel carried by these passageways has a downstream velocity component which facilitates mixing and minimizes the propagation of flashbacks in the upstream direction.

BRIEF DESCRIPTION OF THE DRAWINGS

The present invention will now be described with reference to the accompanying drawings showing preferred embodiments of the cutting torch of the present invention. In the figures.

DETAILED DESCRIPTION OF THE INVENTION

Figure 1:
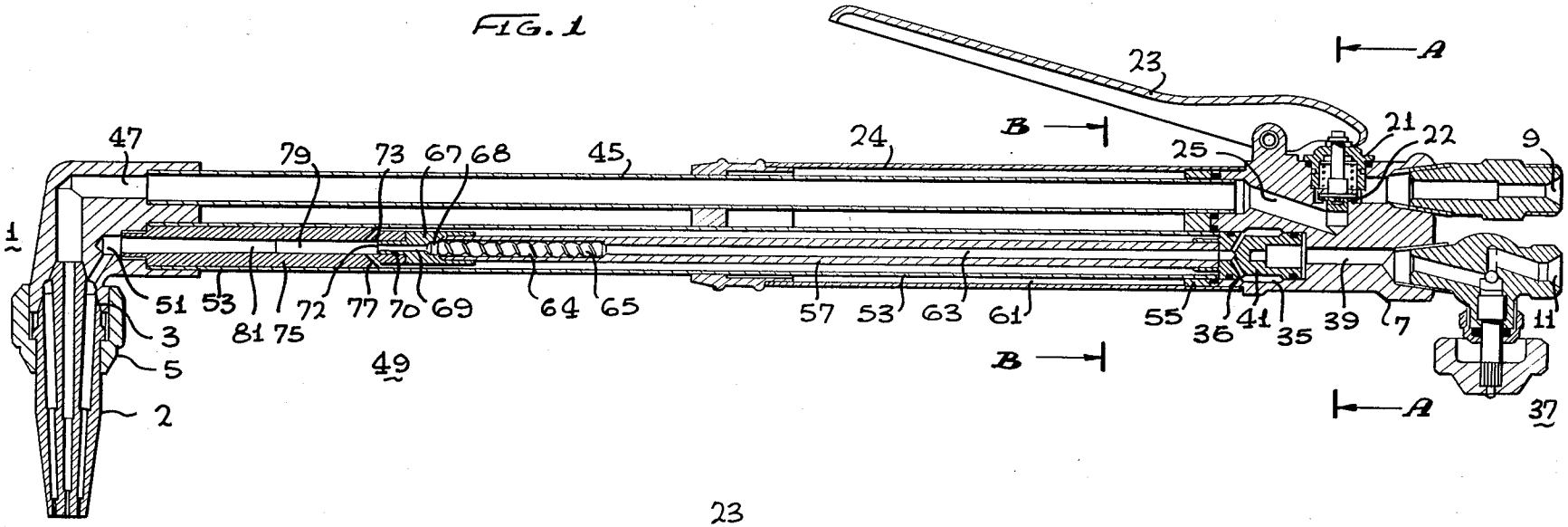
FIG. 1 is a cross-sectional view of the cutting torch of the present invention.

As shown in the figures, the cutting torch of the present invention includes cutting head 1 having opening 3 for receiving a cutting tip 2. The locking nut 5 secures the cutting tip in place on the cutting head 1.

A valve body 7 includes an oxygen inlet 9 and a fuel inlet 11. Valve body 7 also includes a cutting oxygen valve 21 having an operating handle 23. When the operating handle 23 is depressed, the valve seat 22 is opened allowing oxygen from inlet passageway 9 to flow through the valve body and out through cutting oxygen outlet 25.

A gripping barrel 24 may be provided to provide better heat insulation for the user of the cutting torch.

Cutting oxygen tube 45 couples cutting oxygen outlet 25 of the valve body 7 to the cutting oxygen passageway 47 in the cutting head 1.

Figure 2:
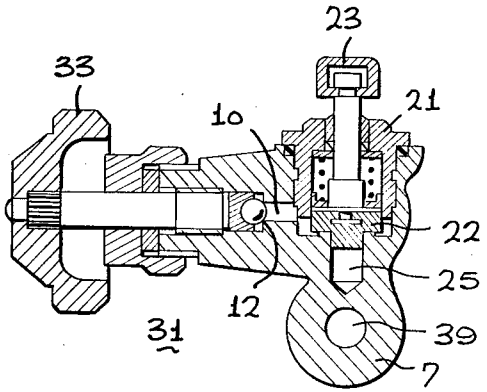
FIG. 2 is an enlarged cross-sectional view taken along line A—A of FIG. 1.

As best shown in FIG. 2, the valve body 7 also includes a preheat oxygen control valve 31 including a knob 33 which can be turned to control the flow of oxygen from the inlet passageway 9 to the preheat oxygen outlet 35 via a passageway 10, valve seat 12 and a small passageway (not shown) from the valve seat area to outlet 35.

Figure 5:
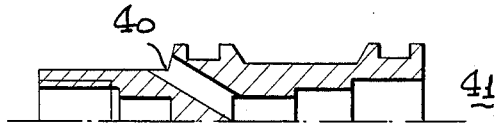
FIG. 5 is a cross-sectional view taken along line C—C of FIG. 4.

Fuel inlet 11 communicates via a fuel control valve 37 to preheat fuel outlet 39. The fuel is thence conveyed to an annular fuel passageway 61 in the preheat tube assembly 49 while the oxygen is conveyed to the oxygen bore 63 therein. Both gases travel via separator 41. The oxygen is conveyed radially inwardly by passageways 36 in separator 41 while the fuel is conveyed radially outwardly by passageways 40 (shown FIG. 5) in separator 41.

The preheat tube assembly 49 couples to the preheat oxygen outlet 35, 36 and the preheat fuel outlet 39, 40 of the valve body 7 and separator 41 to the preheat mixture passageway 51 of the torch head 1.

Figure 3:
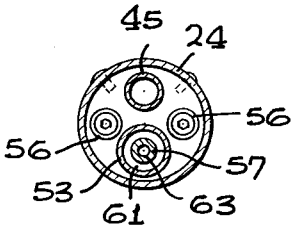
FIG. 3 is a cross-sectional view taken along line B—B of FIG. 1.

The preheat tube assembly 49 includes an outer tube 53 which is secured at its first end to a block 55 which in turn is removably secured to the valve body 7 by means of fasteners 56 (FIG. 3). The second end of the outer tube 53 is secured to the cutting head 1. Inner tube 57 is slidably received within the outer tube 53 and includes a first end which threadably engages separator 41. The second end of the inner tube 57 is preferably threadably received within a first end of a nozzle fitting 67.

Figure 4:
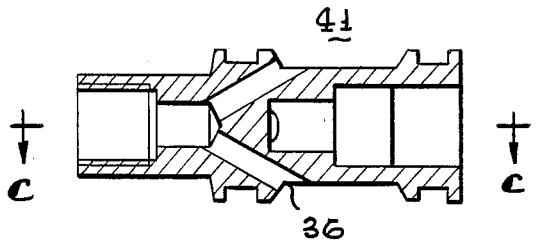
FIG. 4 is an enlarged cross-sectional view of the separator.

The outer surface of the inner tube 57 and the inner surface of the outer tube 53 define the aforementioned annular fuel passageway 61. This passageway communicates with preheat fuel outlet 39 of valve body 7 via passageways 40 (FIG. 5) in separator 41. The inner bore 63, 64 of inner tube 57 defines an oxygen passageway which communicates with preheat oxygen output 35 of valve body 7 via passageway 36 in separator 41. O-rings seal the separator 41 in the valve body 7 to prevent leakage between the fuel passageways and the oxygen passageways. Separator 41 is shown in greater detail in FIGS. 4 and 5.

The bore of the inner tube preferably has two portions of differing internal diameters. The first portion 63 has a smaller diameter than second portion 64. A heat absorbing spiral 65 is installed in the second portion 64 to impart rotation to the oxygen travelling in the oxygen channel.

Figure 6:
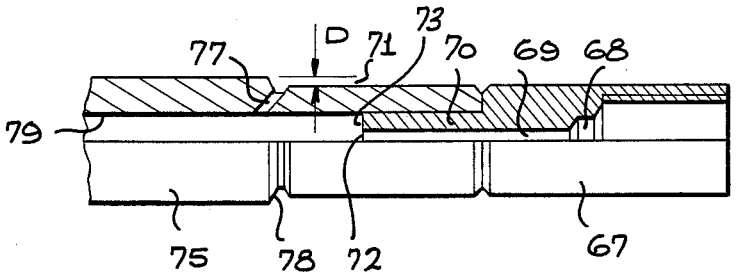
FIG. 6 is a one-quarter cut away view of the nozzle fitting and a portion of the mixer tube.

Nozzle fitting 67, which is also depicted in FIG. 6, has an oxygen passageway or bore 68, 69 therein which communicates with the oxygen passageway 63 in inner tube 57. Fitting 67 also has a blunt-nosed boss 70 which is received by a first end of a mixer tube 75 and which forms a nozzle or jet 72 therein for ejecting the oxygen into mixer tube 75. As can be more clearly seen in FIG. 6 at the letter D, the outside diameter of fitting 75 is selected to provide a clearance in the range of 0.1 mm to 0.4 mm between the fitting 75 and the internal surface of outer tube 53, thereby forming an annular fuel channel 71 of very thin dimension. The bore 68, 69 preferably has two portions, a first portion 68 having a larger diameter than a second portion 69. Furthermore, the diameter of the first portion 68 is preferably less than the diameter of the second portion 64 of inner tube 57 while the diameter of the second portion 69 of inner tube 57 is preferably smaller than the diameter of the first portion 63 of inner tube 57. The first and second portions 68 and 69 are joined by a conical diffuser section therebetween as can be seen in FIGS. 1 and 6. Furthermore, a diffuser section is preferably also provided between first portion 68 of the fitting 67 and second portion 64 of the inner tube.

Mixer tube 75 has a mixing channel or central bore 79 and a plurality of symmetrically disposed passageways 77 (preferably three to four in number) which extend between the bore 79 and outer surface of mixture tube 75. The outer surface of mixture tube 75 between the passageways 77 and the first end thereof is preferably of the same outside diameter as fitting 67, so that the thin annular fuel channel 71 extends from passageways 77 to fuel channel 61.

The fuel passing through passageway 77 is mixed with the oxygen emitting from jet 72 and thence communicated to passageway 51 in the cutting head 1. The dowstream end of bore 79 may preferably include a flared portion 81 which increases in diameter in the downstream direction. This flaring section creates a low pressure turbulent area in the mixing channel which enhances the mixing of the fuel and the oxygen.

The fuel and oxygen are initially mixed near the first end of the mixer tube 59 downstream of the fitting 67 and its nozzle 72. The plurality of passageways 77 communicate with both the fuel channel 61 and the mixing channel 79. The passageways 77 are preferably disposed at an acute angle of 30° to 60° with respect to the longitudinal axis of the mixer tube 75 and slant downstream and inward toward the center of the mixer tube 75. An annular recess 78 is preferably formed in the outer wall of the mixer tube 75 and positioned such that the passageways 77 join this annular recess. The downstream wall of this recess may advantageously be formed at a steep angle to the axis of the passageways 77 to facilitate drilling of the passageways.

Passageways 77 intersect bore 79 downstream and axially spaced from the end of boss 70. This creates a quite region 73 outwardly from the jet 72 and upstream of the passageways 77. As will be seen, this quite region 73, improves the anti-flashback capabilities of the torch.

In the normal functioning of the torch, the preheat oxygen flow rate is adjusted using the preheat oxygen control valve 31 and the fuel flow rate is established by fuel control valve 37. The oxygen flows from the control valve 31 to the preheat fuel outlet 35 and through oxygen channels 63, 64, 68 and 69 and through spiral 65. In flowing through the spiral 65, nozzle 72 and diffusers, the oxygen flow becomes significantly more turbulent in order to facilitate mixing of the oxygen with the fuel. The fuel flows through the inlet 11, through the passageway in the valve body 7 and through the fuel outlet 39 and passageways 40 in separator 12 into the fuel channel 61 between the outer tube 53 and the inner tube 57. The fuel then flows into the fuel channel 71, into the recess 78 and through the plurality of passageways 77 into mixing channel 79 where it is mixed with the turbulent oxygen flowing from the nozzle 72. Naturally, the fuel and oxygen continue to mix throughout the length of the mixing channel 79, including the flared section 81 and are completely and uniformly mixed prior to entering the preheat mixture passageway 51 in the cutting head 1.

Normally, the flow rates of the preheat oxygen and the preheat fuel are adjusted so that the mixture ratio of the oxygen and fuel is proper to give a clean burning, high temperature flame at the outlet of the cutting tip and to assure that the flame propagation rate of the mixture is less than or equal to the velocity of the mixture exiting the cutting top. This assures that the mixture will burn only outside of the cutting torch.

If the flow rates are set too low for the size of the cutting tip being used, the flame front will propagate into the torch tip and can progress upstream along the mixing channel 71. This phenomenom is called "flashback" and results in a small explosion within the torch when the flame propagation rate drastically increases as the flame front moves within the torch where the pressures of the oxygen and fuel in the preheat mixture are greater. The explosion sets off a shock wave which can travel throughout the fuel and oxygen passageways causing damage to the upstream components of the system. Additionally, the localized high pressure characterizing the moving shock wave can carry small amounts of oxygen along the fuel line or small amounts of fuel along the oxygen line causing additional flashbacks upstream of the cutting torch with potentially disastrous results. Since many of the fuels used for cutting are unstable at high pressures, the instantaneous high pressures accompanying the shock wave casued by the flashbacks can result in large scale explosions of the fuel tanks.

The above-described preheat tube assembly of the present invention minimizes the flashback possibilities in a number of ways.

First, the blunt-nosed boss 70 defines both (i) the quite region 73 a sharp corner between the front of the nozzle or jet 72 and the internal wall of the central bore 79 of the mixer tube 75, upstream of passageways 77, and (ii) a sharp edge between bore 69 and the front surface of boss 70. Corner 73 is relatively still during normal operation. However, when a flashback occassionally occurs, the abnormal combustion disturbs the steady-state flow and backward flow can occur. The sharp corner 73 and edge apparently cause a vortex to occur under such conditions, which vortex disturbs and helps to break up the flame front, thereby helping to extinguish it and inhibiting its entry into oxygen bore 69.

Second, the thin (0.1 mm to 0.4 mm) annular fuel channel 71 presents a very large surface area (compared to the volumn of the channel) of a heat absorbing metal to reduce the opportunity for a flame front to continue to burn should it reach this area. The outside dimension of the fitting 72 is preferably nine mm while the axial length of the thin annular fuel channel 71 is of the order of 28 mm. Thus, the surface area is approximately 1580 $mm^2$ while the volumn of the channel is only 40 to 160 $mm^3$. Also, the outside diameter of the nozzle fitting 72 is this preferably 91 to 98% of the inside diameter of the outer tube 53.

Third, the differences in the geometry of the cylindrical passageways 77 compared to the mixing channel 75 and the thin annular fuel channel 71 makes it difficult for a flame front to propagate from the mixing channel 75 to the fuel channels 71, 61. The small cross-sectional area of the channel 71 compared to the distribution groove also inhibits the upstream movement of a flame front in this region.

Fourth, the oxygen channel includes not only a heat absorbing spiral 65, but preferably also a pair of diffuser sections on either side of portion 68 in nozzle fitting 67. The rotation and high speed of the resulting oxygen jet helps to break up any combustion waves that might occur.

Fifth, the sharp edge of the nozzle on jet 72 also reduces the possibility of a combustion wave entering the oxygen channel.

In short, the torch described herein has many features which tend to reduce the opportunity for a flashback to propagate extensively into the fuel and oxygen channels of the torch. Yet, the torch is relatively easy to manufacture. Thus, the disclosed torch has superior anti-flashback characteristics and is very economical to produce.

All of the passageways within the preheat tube assembly can be machined by simple conventional techniques and the seals can be formal by using O-rings or tapered threads.

Naturally, the shapes of the various elements of the preheat assembly may be varied for specific purposes and the various seals may be formed using other conventional means. Additionally, the principals of the present invention can also be used in a machine torch in which the preheat oxygen and preheat fuel control valve are positioned in a location remote from the preheat tube and connected to the preheat tube by flexible tubing or the like.

Accordingly, while a specific embodiment of the present invention has been disclosed, it is to be understood that the disclosed embodiment has been made by way of example and that numerous changes in the details of constructions are foreseen. Accordingly, the scope of the present invention is to be limited only by the appended claims.

I claim:

1. A cutting torch comprising:

a cutting head for receiving a removable cutting tip;

a valve body having an oxygen inlet, a fuel inlet, a cutting oxygen outlet, a preheat oxygen outlet, and a preheat fuel outlet communicating with said fuel inlet;

a cutting oxygen control valve for controlling the flow of oxygen from said oxygen inlet to said cutting oxygen outlet;

a preheat oxygen control valve for controlling the flow of oxygen from said oxygen inlet to said preheat oxygen outlet;

a cutting oxygen tube connecting said cutting oxygen outlet to said cutting head; and a preheat tube connecting said preheat oxygen outlet and said preheat fuel outlet with said cutting head, said preheat tube including:

(i) an annular outer tube having a first end connected to said valve body and a second end connected to said cutting head;

(ii) an inner tube having an oxygen channel therein, said inner tube being disposed in said outer tube and defining a fuel channel therebetween, said inner tube having a first end sealingly connected to said valve body;

(iii) a nozzle fitting disposed in said outer tube and having a first end sealingly connected to a second end of said inner tube;

(iv) a mixer tube disposed in said outer tube and having a first end sealingly connected to a second end of said nozzle fitting, said mixer tube further being sealingly connected to said cutting head, and having a central bore therein and a plurality of transverse passageways disposed between said outer tube and said central bore, said passageways intersecting said central bore spaced at a predetermined distance from said first end of said mixer tube;

said oxygen channel in said inner tube being defined by a bore in said inner tube, said bore being of a first diameter remote from said second end of said inner tube and being of a second diameter adjacent said second end of said inner tube, said second diameter being greater than said first diameter;

(v) a heat absorbing metallic spiral disposed in said bore adjacent said second end of said inner tube, said spiral having a diameter greater than said first diameter of said bore;

said nozzle fitting having a bore therein in fluid communication with the bore in said inner tube and the central bore in said mixer tube, the diameter of the bore in said fitting being less than said second diameter, said fitting further having a blunt-nosed boss protruding from its second end into the central bore of said mixer tube, the length of said boss being less than said predetermined distance.

2. A cutting torch as claimed in claim 1, wherein said fitting has an outside radius which is no more than 0.4 mm less than the inside radius said outer tube thereby defining an annular fuel channel having a radial clearance of no more than 0.4 mm.

3. The cutting torch as claimed in claim 2, wherein the outside radius of said mixer tube between the first end thereof and said transverse passageways is essentially the same as the outside radius of said fitting.

4. The cutting torch as claimed in claim 3, wherein said mixer tube has a circumferential groove in an outer surface thereof which intersects with said transverse passageways.

5. The cutting torch as claimed in claim 1, wherein said transverse passageways are disposed at a 30° to 60° angle to the axis of the central bore of said mixer tube.

6. The cutting torch as claimed in claim 1, wherein the bore in said fitting is of one diameter adjacent the first end thereof and of another diameter adjacent the second end thereof, said one diameter being greater than said another diameter.

7. The cutting torch as claimed in claim 6, wherein said one diameter and another diameter are joined by a diffuser and wherein said another diameter is smaller than the first diameter of said inner tube.

8. The cutting torch as claimed in claim 1, further including a gas separator fitting in fluid communication between the oxygen and fuel inlets in said valve body and the oxygen and fuel channels in said preheat tube, said separator conveying the fuel radially outwardly while at the same time conveying the oxygen radially inwardly.

9. The cutting torch as claimed in claim 1, wherein the outside diameter of said nozzle fitting is between 91% to 98% of the inside diameter of said outer tube.

10. A preheat tube for use in a cutting torch, having a cutting head and a valve body, said preheat tube comprising:

an outer tube having a first and second end;

an inner tube having a channel therein, said inner tube being disposed in said outer tube, said inner tube having a first end for sealing connection to the valve body of the torch;

a nozzle fitting disposed in said outer tube and having a first end sealingly connected to a second end of said inner tube;

a mixer tube disposed in said outer tube and having a first end sealingly connected to a second end of said nozzle fitting and a second end for sealing connection to the cutting head, and having a central bore therein and a plurality of transverse passageways disposed between said outer tube and said central bore, said passageway intersecting said central bore at a predetermined distance spaced from said first end of said mixer tube;

said bore in said inner tube being a first diameter remote from said second end of said inner tube and being of a second diameter adjacent said second end of said inner tube, said second diameter being greater than said first diameter;

a heat absorbing metallic spiral disposed in said bore adjacent said second end of said inner tube, said spiral having a diameter greater than said first diameter of said bore;

said nozzle fitting having a bore therein in fluid communication with the bore in said inner tube and the central bore in said mixer tube, the diameter of the bore in said fitting being less than said second diameter, said fitting further having a blunt-nosed boss protruding from its second end into the central bore of said mixer tube, the length of said boss being less than said predetermined distance.

11. A preheat tube as claimed in claim 10, wherein said fitting has an outside radius which is no more than 0.4 mm less than the inside radius, said outer tube thereby defining an annual channel having a radial clearance of no more than 0.4 mm.

12. The preheat tube as claimed in claim 11 wherein the outside radius of said mixer tube between the first end thereof and said transverse passageways is essentially the same as the outside radius of said fitting.

13. The preheat tube as claimed in claim 10, wherein said mixer tube has a circumferential groove in an outer surface thereof which intersects with said transverse passageways.

14. The preheat tube as claimed in claim 10 wherein said transverse passageways are disposed at a 30° to 60° angle to the axis of the central bore.

15. The cutting torch as claimed in claim 1, wherein said boss of said fitting has a generally planar face which is disposed essentially perpendicular to the centerline of the bore of the fitting.

16. The preheat tube as claimed in claim 10, wherein said boss of said fitting has a generally planar face which is disposed essentially perpendicular to the centerline of the bore of the fitting.

17. A preheat tube for use in a cutting torch having a cutting head and a valve body, said preheat tube comprising:

(a) an elongated tube having an essentially constant cross section throughout its lenth between said head and said body;

(b) means in said tube defining oxygen and fuel passageways therein; and (c) a fuel and oxygen mixing assembly disposed inside said tube, said assembly including means defining an oxygen channel and a plurality of fuel channels disposed at an angle to and intersecting the oxygen channel and a jet disposed in said oxygen channel and spaced a predetermined distance upstream of where the fuel channels intersect the oxygen channel.

18. The preheat tube as claimed in claim 17, wherein said mixing assembly has inner and outer surfaces, the inner surfaces defining the oxygen channel, said fuel channels therein being arranged between said inner and outer surfaces and wherein the outer surface of said fitting between the point where the fuel channels intersect same and a distal end thereof upstream of said jet is spaced a predetermined distance from the inner wall of said tube to define a conduit which is in fluid communication with said fuel passageway.

19. The preheat tube as claimed in claim 17 wherein said means defining oxygen and fuel passageways in said tube comprise an inner tube having an outside dimension less than the inside dimension of said elongated tube, said inner tube being connected to said mixing assembly and having a heat absorbing spiral disposed therein adjacent said mixing assembly.

* * * * *